US009245724B2

(12) United States Patent
Stoermer

(10) Patent No.: US 9,245,724 B2
(45) Date of Patent: Jan. 26, 2016

(54) LATERAL INTRODUCTION OF IONS INTO RF ION GUIDES

(75) Inventor: Carsten Stoermer, Bremen (DE)

(73) Assignee: BRUKER DALTONIK GMBH, Bremen (DE)

( * ) Notice: Subject to any disclaimer, the term of this patent is extended or adjusted under 35 U.S.C. 154(b) by 0 days.

(21) Appl. No.: 13/560,634

(22) Filed: Jul. 27, 2012

(65) Prior Publication Data

US 2013/0026360 A1 Jan. 31, 2013

(30) Foreign Application Priority Data

Jul. 27, 2011 (DE) ..... 10 2011 108 691

(51) Int. Cl.

| | |
|---|---|
| ***H01J 49/42*** | (2006.01) |
| ***H01J 49/06*** | (2006.01) |
| ***H01J 49/00*** | (2006.01) |
| *H01J 49/22* | (2006.01) |

(52) U.S. Cl.

CPC ..... *H01J 49/063* (2013.01); *H01J 49/0072* (2013.01); *H01J 49/068* (2013.01); *H01J 49/423* (2013.01); *H01J 49/22* (2013.01)

(58) Field of Classification Search

CPC ... H01J 49/4255; H01J 49/423; H01J 49/107; H01J 49/063; H01J 49/068; H01J 49/0072; H01J 49/22

USPC ..... 250/281, 290, 291, 292

See application file for complete search history.

(56) References Cited

U.S. PATENT DOCUMENTS

| | | | | |
|---|---|---|---|---|
| 3,920,987 | A * | 11/1975 | Anbar et al. | 250/282 |
| 5,420,425 | A * | 5/1995 | Bier et al. | 250/292 |
| 6,515,279 | B1 * | 2/2003 | Baykut | 250/285 |
| 7,196,326 | B2 | 3/2007 | Franzen et al. | |
| 7,456,397 | B2 | 11/2008 | Hartmer et al. | |
| 2005/0056778 | A1 * | 3/2005 | Thomson et al. | 250/288 |
| 2005/0199804 | A1 | 9/2005 | Hunt et al. | |
| 2007/0045533 | A1 * | 3/2007 | Krutchinsky et al. | 250/290 |
| 2007/0057178 | A1 | 3/2007 | Chernushevich et al. | |
| 2007/0057180 | A1 * | 3/2007 | Hansen et al. | 250/292 |
| 2008/0061227 | A1 | 3/2008 | Kovtoun | |
| 2008/0156980 | A1 * | 7/2008 | Rather et al. | 250/287 |
| 2009/0032700 | A1 * | 2/2009 | Park et al. | 250/282 |
| 2009/0065691 | A1 * | 3/2009 | Kovtoun | 250/282 |
| 2010/0193680 | A1 * | 8/2010 | Makarov et al. | 250/282 |
| 2011/0127417 | A1 * | 6/2011 | Ibrahim et al. | 250/282 |
| 2012/0256082 | A1 * | 10/2012 | Masujima et al. | 250/282 |
| 2012/0305759 | A1 * | 12/2012 | Park | 250/282 |
| 2013/0140453 | A1 * | 6/2013 | Verenchikov et al. | 250/282 |

FOREIGN PATENT DOCUMENTS

| | | |
|---|---|---|
| GB | 2415087 | 12/2005 |

* cited by examiner

*Primary Examiner* — Brooke Purinton
(74) *Attorney, Agent, or Firm* — O'Shea Getz P.C.

(57) ABSTRACT

An ion guide system includes an ion guide with pole rods, a device for laterally introducing an ion species, and a mass spectrometer for analyzing product ions of reactions between different ion species. The device is configured and positioned such that an RF field with at least two-fold rotational symmetry with respect to the axis is generated. The device includes shortened pole rods and/or further electrodes. The pole rods and the further electrodes have at least two-fold rotational symmetry. The symmetry of the RF field allows ions to travel straight ahead through the ion guide with no hindrance. Such arrangements are particularly suitable for bringing together largely loss-free positive and negative ion species for reacting them. The reactions may be used to fragment multiply charged biopolymer ions by electron transfer or to remove excess charges of multiply charged biopolymer ions.

14 Claims, 5 Drawing Sheets

LATERAL INTRODUCTION OF IONS INTO RF ION GUIDES

PRIORITY INFORMATION

This patent application claims priority from German Patent Application 10 2011 108 691.2 filed on Jul. 27, 2011, which is hereby incorporated by reference.

FIELD OF THE INVENTION

The invention relates to mass spectrometry, and more particularly to an RF ion guide, in particular a quadrupole ion guide, with a device for the lateral introduction or extraction of ions, and to a mass spectrometer for analyzing the product ions of reactions between different ionic species.

BACKGROUND OF THE INVENTION

In mass spectrometric analysis, and biopolymer analysis in particular, reactions between positively and negatively charged particles with subsequent analysis of the reaction products are becoming more and more important.

Methods for the non-ergodic fragmentation of biopolymer molecules, predominantly of peptides and proteins, were elucidated several years ago. They include causing the biopolymer ions to react with electrons, resulting in the cleavage of the chain-type molecules. The process starts with multiply charged positive ions, which are produced by attached protons. The neutralization of a proton leads to a spontaneous cleavage of the biopolymer chain by rearrangement. If the molecules were doubly charged, then one of the two fragments produced remains charged as an ion; two fragment ions are usually formed from ions with a higher charge.

The fragmentation of peptides and proteins follows simple rules. While collision-induced fragmentation essentially breaks the "peptide b and y bonds" (according to the familiar Roepsdorf-Fohlmann-Biemann nomenclature) between the amino acids, the cleavages induced by electrons concern the neighboring "c bonds" within the amino acids, the c cleavages being distributed more or less evenly over all amino acids (the sole exception is proline, whose ring structure means the fragmentation does not lead to a separation of the chain) It is therefore relatively simple to deduce the primary structure of the molecule from the fragmentation pattern; the amino acid sequence becomes easy to read from the fragmentation spectrum. It is considerably easier to interpret these electron-induced fragment spectra than it is to interpret collision-induced fragment spectra (CID=collision-induced dissociation), whose fragment ions do not exhibit such a uniformly high pattern. However, since electron-induced fragment ions retain all their side chains, whereas these are lost in collision-induced fragmentation, a comparison of the two types of fragment spectra provides decisive information when investigating post-translational modifications (PTM).

If slow, free electrons are captured by multiply charged biopolymer ions, for example protein or peptide ions, this is called electron capture dissociation (ECD). A similar fragmentation occurs when multiply charged positive ions of biopolymers react with negatively charged ions with low electron affinity, for example with radical anions of fluoranthene, azulene or 1-3-5-7-cyclooctatetraene. The reactions have been described in the documents DE 10 2005 004 324 B4; GB 2 423 865 B; U.S. Pat. No. 7,456,397 B2; (R. Hartmer and A. Brekenfeld; 2005) and US 2005 0 199 804; EP 1 723 416; WO 2005/090978 (D. F. Hunt et al., 2004). This results in the transfer of electrons, which leads to a fragmentation of the biopolymer ions. This fragmentation by electron transfer resembles fragmentation by electron capture to a large extent. Electron transfer dissociation is abbreviated to ETD.

The fragmentation of multiply charged negative analyte ions by reactions with positively charged reactant ions (NETD) is known. In this case, the fragmentation occurs after the transfer of an electron to the positive reactant ion.

Reactions between multiply charged positive ions and negatively charged ions can also serve to largely strip the charge from the multiply charged positive ions. This is done by using non-radical negative ions with high proton affinity, which remove protons from the positively charged ions but do not cause any fragmentation in the proton transfer reaction (PTR). It is thus possible to transfer multiply charged protein ion mixtures with broad charge distribution with 10, 20 or 50 protons into a mixture consisting only of ions with few charges, in the limiting case practically only of singly charged ions. This mixture of singly charged ions can be analyzed in simple mass spectrometers without the need for a complicated charge deconvolution of the mass spectrum obtained, if the mass range of the mass spectrometer allows such an analysis.

RF ion guides play an important role in modem mass spectrometers because they can guide both positive and negative ions from ion sources through different vacuum stages to mass filters, reaction cells or mass analyzers. Ion guides are normally designed as multipole rod systems which are usually operated with a two-phase RF voltage, the two phases being applied in turn across the pole rods. The pole rods of systems, which serve only to transmit ions, often encompass an interior space with a diameter measuring only around two to four millimeters; in principle, however, mass filters with internal diameters of six to eight millimeters are also classed as ion guides. The RF voltage across the rods of the narrow rod systems is usually not very high. In the case of commercial ion guides it is only a few hundred volts at a frequency of a few megahertz. In the interior, the multipole RF field generates a so-called "pseudopotential", which drives the ions above a threshold mass to the central axis, causing them to execute so-called secular oscillations in the potential well of this field. If the ion guides are operated with a collision gas at a pressure between 0.01 and 10 pascal, the ion motions are damped and the ions are collected in the axis of the system because of the effect of the pseudopotential. At a pressure of 0.1 pascal the ions are damped within a few milliseconds. In the simplest case, these gas-filled systems are used only to guide ions, but otherwise also as collision cells for ergodic collision-induced fragmentation or as reaction cells for electron transfer dissociation of analyte ions.

The driving force which feeds the ions through the ion guide is usually achieved by injecting the ions with sufficient energy to pass through the damping gas in the ion guide; it is also possible to use gas flows with viscous entrainment of the ions or weak DC electric fields in the longitudinal direction. The ions can also be driven by their own space charge if sufficient ions are fed in from one end.

Octopole, hexapole and also quadrupole rod systems are used as ion guides. Octopole rod systems provide a wide pseudopotential well for the ions in the interior which does not focus the ions sharply onto the axis. The ions may even be driven to the edge of the well by their space charge when large numbers of ions are injected. The best guiding characteristics near the axis are achieved by quadrupole rod systems because they provide the narrowest pseudopotential well. This is advantageous particularly when the analyte ions are to be fed as a fine ion beam to a pulser of a time-of-flight mass spectrometer with orthogonal ion injection, or if they are to be introduced into a quadrupole mass filter. Injecting the ions into a mass filter is difficult because they are opposed by strong fringe fields (except precisely on the axis), so a quadrupole ion guide with its optimum axial focusing provides the best conditions for a low-loss injection of the analyte ions.

When designing and using any ion guide the aim is for it to transport the analyte ions as free from disturbances and losses as possible. Analyte ions are often only produced in small quantities; they must therefore be handled carefully until they or their reaction products can be analyzed in the mass analyzer.

It is preferable if reactions between ions of different polarity are carried out in reaction cells. These can take the form of three-dimensional RF ion traps, for example, but are often constructed as ion guides, which must then be closed at both ends to prevent the ions escaping. Such a closure can be achieved by means of pseudopotential barriers at the ends. There are several embodiments for these barriers in the literature and in practice, which are known to those skilled in the art. The ions can be introduced into the reaction cells from the ends or from the side. If the ions are introduced from the ends, they are again guided there by ion guides. The analyte and reactant ions are usually introduced in succession. For this procedure it is often necessary to guide the reactant ions, which have been produced in special ion sources, laterally into the ion guides in order to feed them through the ion guides and into the reaction cells.

U.S. Pat. No. 7,196,326 describes basic ion guides into which the ions can be introduced laterally with the aid of laterally docked ion guides and with the joint use of the RF voltage. The joint ion guides can guide ions of both polarities to reaction cells, and can also be used directly as reaction cells. An example in the form of two coupled quadrupole rod systems from this document is shown in FIG. 1. The analyte ions are guided in a straight line through the ion guide. Experiments have shown, however, that the side inlet changes the RF field in the interior to such an extent that the guiding of the analyte ions in a straight line is greatly disturbed. Unacceptable analyte ion losses occur.

A simple arrangement for the lateral introduction of ions into an ion guide is described in U.S. Pat. No. 7,456,397. It is an octopole rod system which has two slightly shortened pole rods in front of a ring diaphragm. The reactant ions are introduced laterally into the gap created, and are deflected into the octopole rod system by a DC voltage at the ring diaphragm. This arrangement has proven to be fairly effective experimentally; it has two disadvantages, however. First, the RF field in the interior of the octopole rod system is disturbed by an asymmetry here also, leading to some analyte ion losses. Second, the octopole ion guide exhibits the familiar difficulties of not very good axial focusing. The octopole rod system is disadvantageous particularly for the transmission of the ions to a time-of-flight mass spectrometer with orthogonal ion injection or to a 2-dimensional or 3-dimensional RF quadrupole ion trap.

With all ion guides, including those with lateral introduction of ions, switching the RF voltage must always be avoided because generally the generators used are accurately tuned to the capacity of the ion guide. It is preferable if only a superposed DC voltage is switched.

SUMMARY OF THE INVENTION

Asymmetric disturbances in the basic ion created by the inlets for the lateral introduction, are reduced (preferably eliminated) at the point where the ions are introduced. This is achieved by devices which form RF fields with at least two-fold rotational symmetry about the axis of the basic ion guide at the point where the lateral introduction takes place. The electrodes of the basic ion guide, and any further electrodes of the ion introduction if present, must also have at least two-fold rotational symmetry if they have a substantial influence on the pseudopotential near the axis.

The device for the lateral introduction of the ions into the basic ion guide can consist solely of a modification to the pole rods themselves, or changes to the pole rods in conjunction with further electrodes. With a basic octopole rod system, for example, four of the eight pole rods can be shortened. For other embodiments, in contrast, additional electrodes are inserted into the gaps between split pole rods of the basic ion guide. The pole rods of the basic ion guide can have a circular cross-section, for example, as in most conventional mass spectrometers, but also any other form of cross-section.

Two-fold rotational symmetry means that each time the arrangement of the basic ion guide is rotated by 180°, the original configuration is restored. With three-fold rotational symmetry, this would be the case for rotations of 120°, and so on. With two-fold symmetry, it follows from the rotational symmetry requirement for the RF fields that the basic pole rods and the device for the lateral introduction of ions must have mirror symmetry with respect to a plane which passes through the axis of the ion guide and is perpendicular to the lateral direction of the introduction. The RF fields then have inverse mirror symmetry relative to this plane.

Loss-free deflection of the laterally introduced ions around the corner into the straight ahead direction of the basic ion guide can be achieved by insulated electrode segments of the ion guide which have a deflecting DC voltage in addition to the RF voltage. This DC voltage is not symmetrical; it is only applied in the phases of lateral introduction or extraction of ions. "Insulated" means in this context that the electrode segments are electrically connected such that they can be independently supplied with voltages. It does not necessarily mean that the voltages applied to the electrode segments are always different from those applied to adjacent electrodes; however, in certain phases of operation they can be.

To introduce ions into an octopole ion guide, according to the prior art with two shortened octopole rods, the device for the lateral introduction can comprise shortening two opposing rod pairs. This satisfies the symmetry requirements stated.

One embodiment of the device for the lateral introduction comprises splitting the four rods of a basic quadrupole rod system and symmetrically inserting four narrow electrodes with RF voltage of the opposite phase into the four gaps. Hexapole injection channels are then created at this location between each pair of rods. The channel of the pseudopotential widened only slightly in the straight ahead direction of the ion guide. No resistance against the flow of the ions in the straight ahead direction is generated, nor is there any lateral deflection. The hexapole injection channel allows ions to be guided through at right angles to the basic quadrupole rod system. If they are to be deflected around the corner into the axis of the basic quadrupole rod system, appropriate DC voltages can be applied to neighboring, insulated segments of the pole rods. The ions injected through the hexapole channel can then be accurately deflected into the longitudinal direction of the ion guide in a transverse DC quadrupole field. Any ion guides, e.g., hexapole ion guides, can be connected to the outside of the hexapole channel. The transverse, DC quadrupole field can also be used for a highly efficient deflection of the analyte ions from the straight ahead direction of the basic quadrupole rod system into the laterally mounted ion guide.

An aspect of the invention comprises a mass spectrometer for the scanning of reaction products from reactions of differently charged analyte and reactant ions. This mass spectrometer comprises not only the ion source for the production of the analyte ions and the ion guide with side inlet, but also an ion source for producing the reactant ions, which are introduced into the ion guide through the side inlet, a reaction cell and a mass analyzer. A time-of-flight mass analyzer with orthogonal ion injection for acquiring the mass spectra of the reaction products is particularly favorable. The analyte ions, usually multiply charged positive ions, are best generated with an electrospray ion source.

In various embodiments, a reaction cell is present in the mass spectrometer, and ions of the first ion species and ions of the second ion species are fed into the reaction cell.

In some embodiments, ions of the first ion species and ions of the second ion species are made to react with each other at the point where the lateral ion feed enters.

In various embodiments, the input of ions of the second ion species can be switched on and off.

The ion source for the production of ions of the first ion species can be an electrospray ion source. The ion source for producing ions of the second ion species, on the other hand, may be an electron attachment ion source.

In various embodiments, the mass spectrometer may comprises a cell for collisional fragmentation of ions of the first ion species.

In some embodiments, ions of the first ion species are generated from analyte substances and ions of the second ion species are generated from reactant substances, or vice versa.

These and other objects, features and advantages of the present invention will become more apparent in light of the following detailed description of preferred embodiments thereof, as illustrated in the accompanying Figures.

BRIEF DESCRIPTION OF THE DRAWING

FIG. 5 shows the distribution of the pseudopotential in the center plane between two pairs of rods; this pseudopotential widens slightly in the center, but there is no potential in the axis deflecting the ions in a sideward direction; ions can move through the ion guide along the axis without any hindrance;

DETAILED DESCRIPTION OF THE INVENTION

An aspect of the invention comprises removing/reducing asymmetric disturbances in the basic ion guide, which in some prior art are created by the wide openings for the lateral introduction. The electrodes of the basic ion guide around the lateral ion introduction have a multi-fold, at a least two-fold rotational symmetry in relation to the axis of the basic ion guide. The supply of the associated RF voltages results in an RF field with rotational symmetry with corresponding symmetrical distribution of the pseudopotentials. The channel of the pseudopotential is only widened slightly in the longitudinal direction of the ion guide. No resistance is generated to the ions flowing in the straight ahead direction, nor is there any lateral deflection; this means that no analyte ions guided in the straight ahead direction are lost as long as they move close to the axis. The analyte ions can move by virtue of their injection energy, but also due to a motion of the damping gas in the ion guide, or in particular due to a combination of both.

Figure 1:
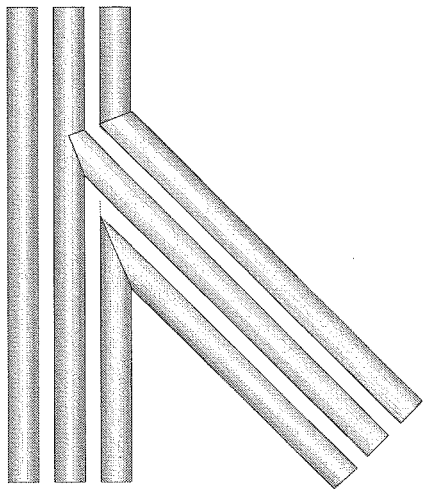
Figure 1 (Prior Art)
FIG. 1 shows a prior art ion-feeding quadrupole rod system according to U.S. Pat. No. 7,196,326 which joins a continuous basic quadrupole rod system laterally at an angle; the transmission of ions in the straight ahead direction is greatly disturbed by the asymmetric field.
Figure 2:
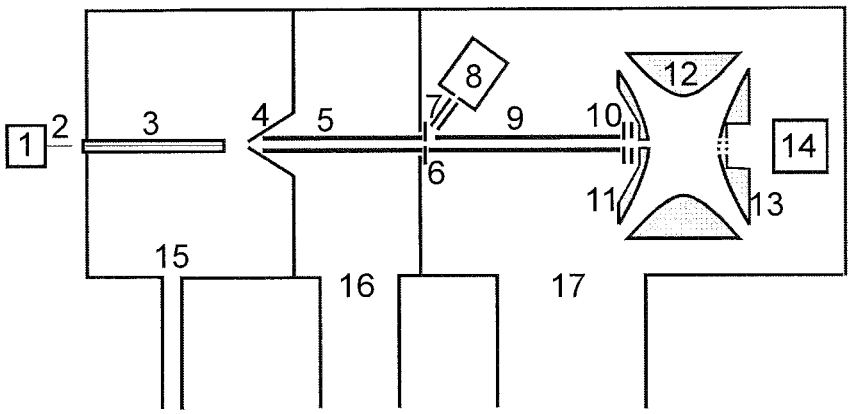
Figure 2 (Prior Art)
FIG. 2 is a greatly simplified schematic representation of an ion trap mass spectrometer according to U.S. Pat. NO. 7,456,397 for the reaction between positive and negative ions, with an electrospray ion source (1, 2) for the production of multiply positively charged analyte ions, an ion source for negative reactant ions (8) and a 3D ion trap (11, 12, 13); the basic ion guide (9) takes the form of an octopole rod system and can guide both positive and negative ions to the ion trap; the negative reactant ions from the ion source (8) are fed in through a gap (7) in the octopole rod system, which is formed by two shortened neighboring pole rods, and are reflected by a DC voltage at the ring diaphragm (6) into the octopole rod system (9); the potential distribution, however, is asymmetrically disturbed, albeit more weakly than in FIG. 1.
Figure 3:
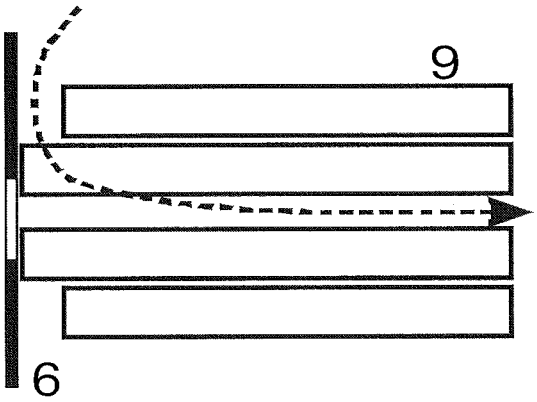
FIG. 3 shows an improved embodiment of the octopole rod system from FIG. 2; the device for the lateral introduction essentially comprises a shortening of two opposing pairs of rods so that a symmetrical field distribution is generated for the transmission of ions in the straight ahead direction; the ions injected laterally (in the Figure, from the top) are deflected around the corner into the octopole rod system (9) by a DC voltage at the ring diaphragm (6); the ring diaphragm (6) is given by way of example only; other shapes for deflective elements connected to a DC voltage supply, which also allow passage of analyte ions in a longitudinal direction, such as grid arrangements, for instance, are also conceivable.

FIG. 2 schematically depicts the prior art for the introduction of ions from a special ion source 8 into a basic octopole ion guide 9. The introduction operates with only two shortened rods and a deflection by a DC voltage on the ring diaphragm 6. According to an aspect of the invention, two opposing rod pairs can be shortened, as depicted in FIG. 3. This shortening of two opposing pole rods corresponds to the symmetry requirement given above.

As has already been described in the introduction, however, octopole rod systems are not capable of focusing the ions into a narrow beam in the axis, and so it is preferable to use quadrupole rod systems as basic ion guides in such mass spectrometers, in which the formation of fine ion beams close to the axis is important. One solution includes generating a hexapole injection channel into such a basic quadrupole rod system, as will be described below.

Figure 4:
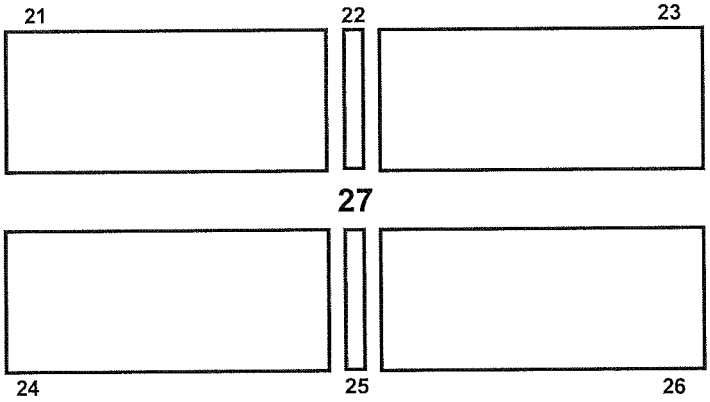
FIGS. 4 and 5 illustrate an RF quadrupole ion guide whose device for the lateral introduction of ions has split pole rods (21/23) and (24/26) of the basic quadrupole rod system; electrode discs (22) and (25) are inserted into the gaps with an RF voltage of opposite polarity; a hexapole injection channel (27) is thus created between the electrode discs (22) and (25) on all four sides of the basic quadrupole ion guide.
Figure 5:
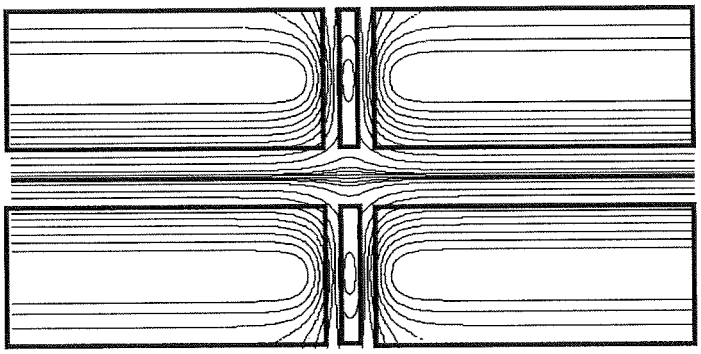

FIG. 4 shows how the pole rods of a basic quadrupole rod system, of which only the pole rods 21/23 and 24/26 are visible here, are split, and how narrow electrodes 22 and 25 are symmetrically inserted into the gaps with an RF voltage in antiphase. Between each rod pair, hexapole field channels 27 are generated between the electrode discs 22 and 25. These field channels can be used as injection channels for ions. The injection channels are generated on all four sides of the basic quadrupole ion guide, between two pairs of rods in each case. As can be seen in the image of the pseudopotential distribution in FIG. 5, the channel of the pseudopotential in the basic quadrupole ion guide is only widened slightly. No resistance against the flow of the ions in the straight ahead direction is generated, nor is there any lateral deflection. The hexapole injection channel allows ions to be injected at right angles into the basic quadrupole rod system.

Figure 6:
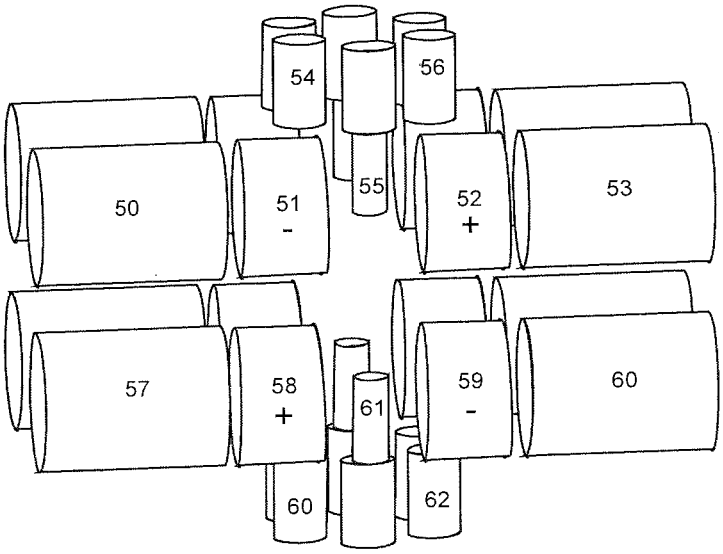
FIG. 6 shows an arrangement for injecting ions through a hexapole rod system (54), (55) and (56) from above into a basic quadrupole rod system with the multiply split pole rod sequences (50, 51, 52, 53) and (57, 58, 59, 60); symmetrical to this, the example shows a bottom arrangement with the hexapole rod system (61), (62) and (63); extensions of the hexapole rods (55) and (61) (and their counterparts behind the axis) now replace the electrode discs (22) and (25) from FIG. 4; the pole rod segments (51), (52), (58) and (59) and their counterparts behind them can each be supplied with DC voltages in addition to the RF voltage, thus generating a transverse DC quadrupole field which can deflect the injected ions around the corner from the hexapole axis into the quadrupole axis.

In the embodiment of FIG. 6, the hexapole injection channel from FIG. 4 has been extended with a hexapole ion guide at the bottom and at the top. The quadrupole rod system includes the multiply split pole rods 50, 51, 52, 53 and 57, 58, 59, 60 and their counterparts behind them. The top hexapole ion guide is represented by the pole rods 54, 55 and 56 and their counterparts behind them, the bottom one by the pole rods 60, 61 and 62. The electrode discs 22 and 25 from FIG. 4, which are supplied with an RF in antiphase, are replaced by extensions of the hexapole rods 55 and 61, which project into the gaps between the pole rod segments 51 and 52 and the pole rod segments 58 and 59 into the quadrupole ion guide, supplied with an RF voltage which is in antiphase to the RF voltage of the pole rods. If the ions are to be deflected by 90° into the axis of the basic quadrupole rod system, appropriate DC voltages must be applied to the insulated segments 51, 52 and 58, 59 of the pole rods, as indicated in the illustration. This generates a transverse DC voltage quadrupole field, which deflects the injected ions from the hexapole axis around the corner into the quadrupole axis.

Figure 7:
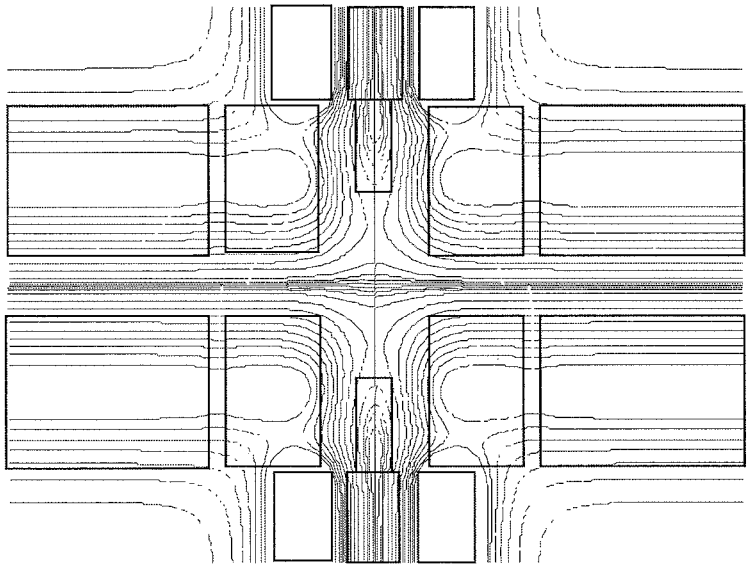
FIG. 7 depicts the distribution of the pseudopotential in the vertical center plane of the arrangement according to FIG. 6.
Figure 8:
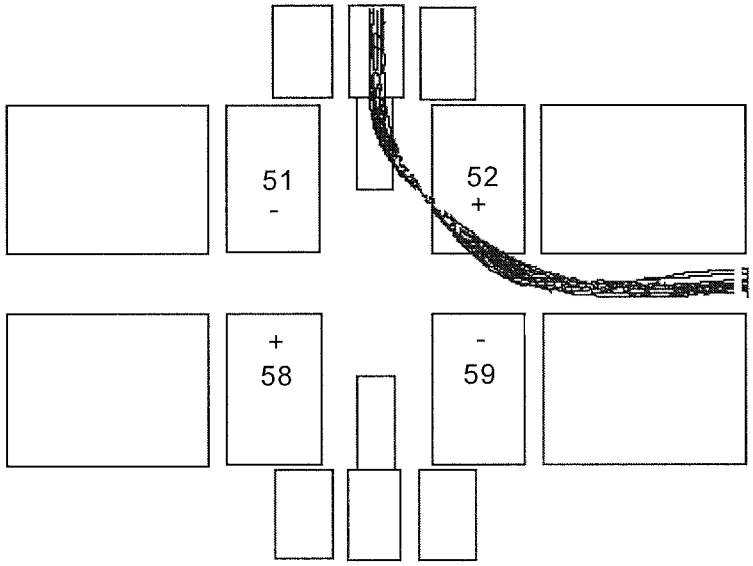
FIG. 8 shows simulation results for the lateral injection of ions with the deflection by RF voltages and additional DC voltages at the pole segments (51), (52), (58) and (59); the deflection is highly efficient and loss-free if the injection energy and deflection voltages are chosen correctly; the ions can also be deflected with high efficiency and without losses from the straight ahead direction of the basic quadrupole rod system into one of the lateral hexapole systems if the ions possess a suitable kinetic energy.

FIG. 7 shows the distribution of the pseudopotential in the center plane through the axis of the arrangement according to FIG. 6; and FIG. 8 shows how the ions injected through the hexapole channel are accurately deflected in a transverse DC quadrupole field into the longitudinal direction of the basic ion guide. The figures are produced by computer simulations. In a similar way, it is also possible to extract ions from the basic quadrupole ion guide into one of the hexapole ion guides. The simulations show that the ions are guided very efficiently in each case.

Since the lateral pole rods 54 and 56 and 60 and 62 of the two hexapole rod systems have practically no effect on the pseudopotential in the interior of the quadrupole ion guide from FIG. 6, they can be omitted for the unused hexapole rod system.

Figure 9:
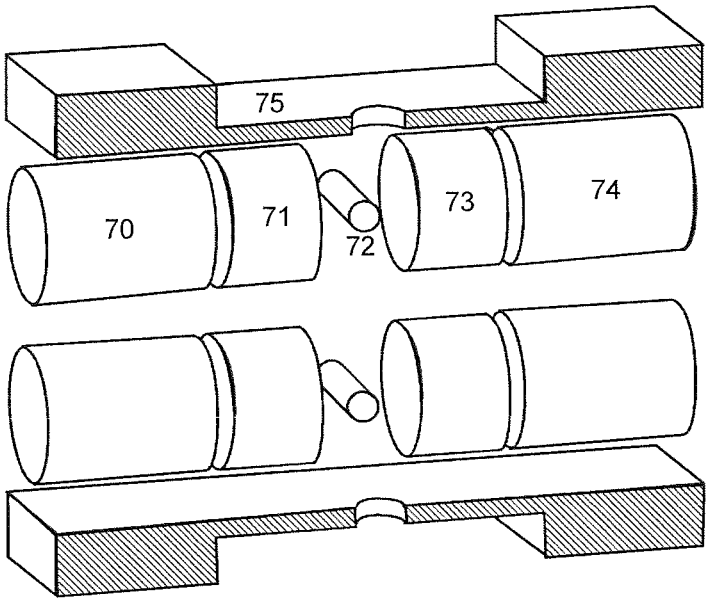
FIG. 9 shows a slightly modified device for the lateral injection of ions into a basic quadrupole ion guide; the basic quadrupole ion guide with the intermediate electrodes (72) supplied with voltages of opposite polarity, of which only the part behind the vertical center plane is shown here, is covered here by plates (75) with an opening through which the ions are injected into the hexapole channel; thus ion guides of any shape can be used outside to deliver the ions, including quadrupole ion guides, for example; here also, analyte ions can be efficiently deflected from the straight ahead direction into the lateral ion guide.
Figure 10:
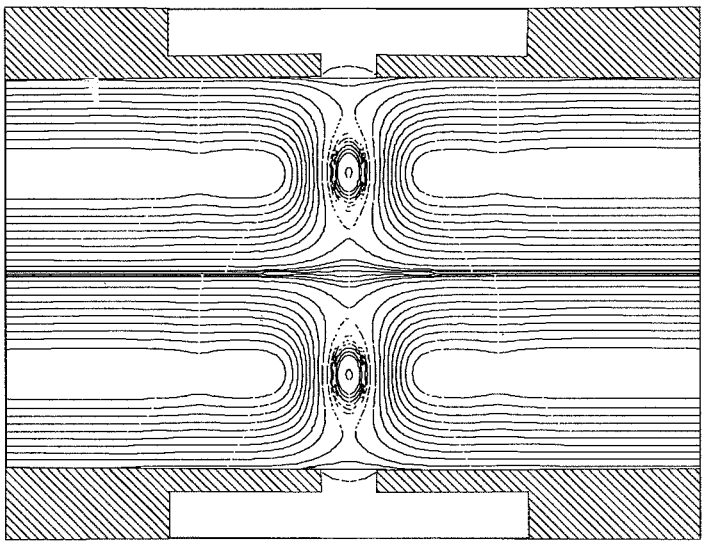
FIG. 10 depicts the distribution of the pseudopotential in the arrangement according to FIG. 9.

FIG. 9 shows an embodiment with a slightly modified device for the lateral injection of ions into a quadrupole ion guide. The quadrupole ion guide with the round intermediate electrodes 72, which are supplied with voltages of opposite polarity, is covered at the top and bottom here by plates 75 with an opening through which the ions can be injected into the hexapole channel between the pole rods. Only the top plate 75 is labeled in the illustration. It is possible to mount ion guides of any shape on the outside of the cover plate 75 of this device to deliver the ions, including quadrupole ion guides, for example. Instead of lateral injection of ions into the basic ion guide, analyte ions can also be efficiently deflected from the straight ahead direction of the basic ion guide into the lateral ion guide.

Figure 11:
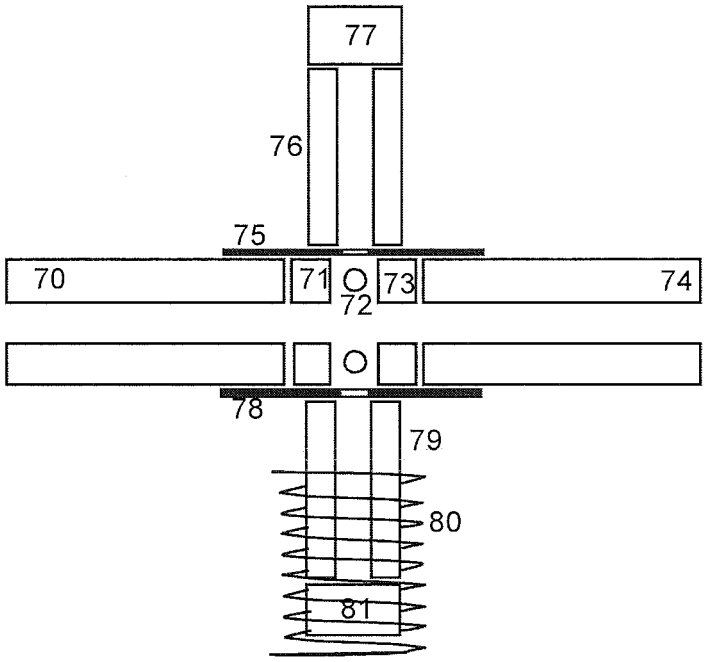
FIG. 11 illustrates how two lateral quadrupole ion guides (76) and (79) are connected, top and bottom, to an arrangement of a basic quadrupole ion guide (70-74) according to FIG. 8; different types of ion sources, ion reactors, ion sinks or ion measuring devices (77) and (81) can be connected to these lateral ion guides; the device (77) can, for example, simply be an ion source for producing negative ions which are to be introduced into the straight line quadrupole ion guide; it is also possible, however, to introduce analyte ions from the basic quadrupole ion guide into the top lateral quadrupole ion guide (76), where they are made to react with negative ions from the ion source (77); the product ions can then be returned into the basic quadrupole ion guide; if positive analyte ions are deflected into the bottom lateral quadrupole ion guide (79), they can be made to react with electrons from the electron source (81), for example; the product ions can then be returned into the basic quadrupole ion guide, where they are transmitted to a mass analyzer; in order to introduce the electrons into the quadrupole ion guide (79), the electron source (81) and the ion guide (79) are surrounded by a solenoid (80), which generates a magnetic field to guide the electrons in the axis of the ion guide.

This arrangement from FIG. 9 is extended in FIG. 11 by two docked quadrupole ion guides 76 and 79. Different types of devices like ion sources, electron sources, reaction cells, or ion detectors 77 and 81 can, in turn, be connected to these ion guides.

If the device 77 is a detector, for example, it can be used to occasionally measure the current of the analyte ions in the straight line quadrupole ion guide. This is necessary, for example, when the ion source is coupled to a chromatographic separation device, delivering substance ions in GC or LC peaks, and an ion storage device, such as a 3D ion trap as in FIG. 2, or an ICR cell, is to be filled as accurately as possible with a specified quantity of ions.

The device 77 can also be an ion source for producing negative ions which are to be introduced into the basic quadrupole ion guide, where they are guided into a reaction cell. On the other hand, it is possible to introduce analyte ions from the basic quadrupole ion guide into the top lateral quadrupole ion guide 76, where they subjected to reactions with negative ions from the ion source 77; the product ions can then be guided back into the basic quadrupole ion guide.

A special operating mode is shown in the bottom part of FIG. 11, where the device 81 represents an electron source. If positive analyte ions are deflected into the bottom quadrupole ion guide 79, they can be subjected to reactions with the electrons from the electron source 81 (ECD, electron capture dissociation). The product ions, for example fragment ions, which have been formed by electron capture dissociation, can then be guided back into the basic quadrupole ion guide, where they are transmitted to further components. In order to introduce the electrons into the lateral quadrupole ion guide 79, the electron source 81 and the ion guide 79 are surrounded by a solenoid 80, which generates a magnetic field of sufficient strength to guide the slow electrons in the axis of the ion guide. The fragmentation by ECD can especially be carried out in continuous flow, the analyte ions being introduced into the lateral quadrupole ion guide 81, reflected at the end and, on return, guided back into the basic quadrupole ion guide. This mode of operation requires the damping gas to have a low pressure so that the kinetic energy of the analyte ions is not reduced too greatly between introducing them into the reaction region 81 and returning them.

In another aspect of the invention, a mass spectrometer for scanning reaction products from reactions between analyte and reactant ions with different charges. The mass spectrometer comprises the ion source for producing the analyte ions; an ion source for producing the reactant ions, which are introduced into the basic ion guide through the lateral inlet; a reaction cell, and a mass analyzer. A time-of-flight mass analyzer with orthogonal ion injection for acquiring the mass spectra of the reaction products is particularly favorable. The analyte ions, usually multiply charged positive ions, are best generated with an electrospray ion source.

Reactions between ions only occur when ions of different polarities are mixed. As has been described in the Background, the reactions can be used for electron transfer dissociation (ETD), for charge reduction by proton transfer (PTR), and also for other types of product formation. Although there have been attempts to create the reactions continuously in a flow, the reactions are usually carried out with ions stored in reaction cells. The reaction cells can be designed as 3D ion traps, as depicted in FIG. 2, but often they are ion guides which are closed at both ends with pseudopotentials. The two ion species are successively, sometimes also simultaneously, introduced into these reaction cells from two different ion sources, often through basic ion guides which have lateral inlets for reactant ions.

Arrangements according to FIG. 6 or 9 can also be used in order to make analyte ions and reactant ions react in the flow at the intersection of the two ion beams.

The laterally introduced reactant ions are preferably produced in separate ion sources. This can occur in ion sources for chemical ionization, for example, which are able to produce both positive and negative ions. Ion sources for chemical ionization operate best at pressures of a few hundred pascal. Since pressures like this are found in the first pumping stage after the capillary inlet, these ion sources can be installed particularly well here. The ion sources for chemical ionization are known to those skilled in the art and do not need to be especially described here.

Apart from chemical ionization, negative ions can also be formed by electron attachment. The ion sources 77 and 36 in the FIGS. 11 and 12 may be such electron attachment ion sources, for example. This type of ion source is likewise known to those skilled in the art and thus is not described here in detail.

Figure 12:
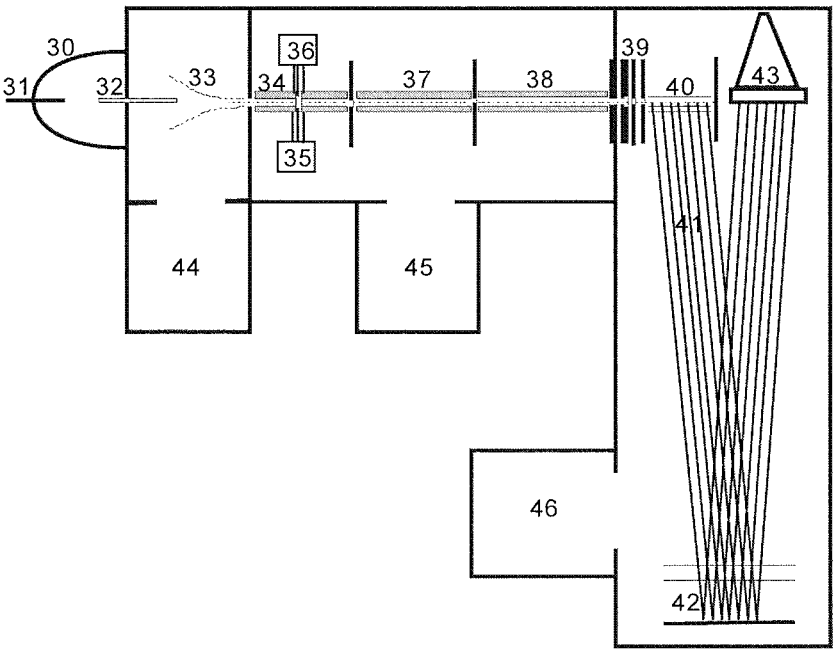
FIG. 12 is a schematic representation of a mass spectrometer according to an aspect of the invention; here, the ions generated with the spray capillary (31) of the ion source (30) are introduced together with ambient gas through the capillary (32) and into an ion funnel (33) made of coaxial ring diaphragms; the trumpet-shaped ion funnel (33) guides the ions into the basic ion guide (34) with two lateral ion injectors or ion extractors, which correspond to the lateral quadrupole ion guides from FIG. 11; several operating modes are possible with this arrangement, some of which are indicated in the description for FIG. 11; it is possible, for example, to produce negative reactant ions in the ion source (36) and, according to this invention, introduce them through a short ion guide into the basic quadrupole ion guide (34); both ion species are guided in succession through the mass analyzer (37), in which the desired, multiply charged positive analyte ions are selected, to the reaction cell (38), where they can react with each other in the desired way; the reaction products are mass selectively analyzed with high resolution in the time-of-flight mass spectrometer with pulser (40), reflector (42) and detector (43).

FIG. 12 is a schematic representation of an embodiment of a mass spectrometer having an electrospray ion source with housing 30 and spray capillary 31. The ions generated with the spray capillary 31 of the ion source 30 are introduced together with ambient gas through the inlet capillary 32 and into the vacuum system. An ion funnel 33 made of coaxial ring diaphragms captures the ions, separates them from most of the introduced gas, and feeds the ions into the basic ion guide 34, which is designed with two lateral inlets as shown in FIG. 11. It is possible, for example, to produce negative reactant ions in the ion source 36 and to introduce them into the basic quadrupole ion guide 34. The two ion species are guided successively through the mass filter 37, in which the desired, multiply charged positive analyte ions are selected, to the reaction cell 38, where they can react with each other in the desired way. The ionic reaction products are introduced as a fine ion beam into the time-of-flight mass spectrometer, accelerated orthogonally to the beam 41 in the puller 40, reflected in the reflector 42 so as to focus the energy, and analyzed in the detector 43 with high mass resolution. Everyone skilled in the art knows how a time-of-flight mass analyzer operates and there is no need to describe it further here.

The quadrupole rod system 34 with the docked ion guides and their ion sources, electron sources, reaction cells or ion detectors can be operated within the mass spectrometer in the various operating modes, which are described above. A different sequence of basic ion guide 34, mass filter 37 and reaction cell 38 can also be chosen if, for example, the parent ions are to be selected from the analyte ions before they are fragmented by ETD or ECD. The rod systems 34, 37 and 38, which here adjoin each other without transition, separated only by diaphragms, can also be separated from each other by further ion guides and vacuum stages and be operated in completely different pressure ranges.

All ion guides are usually filled with damping gas, which causes the ions to collect near the axis of the system due to the effect of the pseudopotential. The slimmer the system, the better the collection. The pressure may range between $10^{-3}$ and $10^{+1}$ pascal, a favorable pressure range is 0.1 to 1 pascal.

A special application of this mass spectrometer offers the possibility of simply analyzing structures of biopolymer ions by ETD fragmentation. For this purpose, the mass spectrometer is connected to a separating system for dissolved substances, such as a nanoflow liquid chromatograph (nano-HPLC). The substances, eluating largely separated one after the other from the LC column, are ionized in the electrospray ion source so as to be predominantly multiply charged. They react with suitable negative ions of low electron affinity by fragmenting into fragment ions of the c-type, which produce an easily decipherable fragment ion spectrum. By periodically switching the supply of negative ions on and off, it is possible to alternately obtain spectra with and without fragmentation. By comparing the spectra, it is possible to determine which peaks of the fragment ion spectrum belong to the fragment ions, even if there is some overlap of substances.

The mass spectrometer can contain a further device for fragmentation. In FIG. 12 the analyte ions selected in the mass filter 37 can also be injected after acceleration into the reaction cell 38, where they absorb small amounts of energy by collisions with the damping gas and can finally fragment. Comparing collisionally fragmented ions with fragment ions generated by electron transfer provides specific information concerning post-translational modifications of the biomolecular structure.

Further applications for this type of mass spectrometer concern the analysis of substance mixtures with high molecular weights, which are usually multiply charged with a broad charge distribution in the electrospray ion source, and thus provide a mixture of peaks in the spectrum which is almost impossible to decipher. By removing the excess charges by proton stripping with suitable negative ions, it is possible to generate a mixture which consists virtually only of singly charged ions and is thus simple to interpret. A time-of-flight mass analyzer in particular is suitable for acquiring spectra with ions of high mass, the mass limit being limited only by the detector employed.

Naturally it is also possible to use other types of mass analyzer instead of time-of-flight mass analyzers to acquire the spectra of product ions, such as ion cyclotron resonance mass spectrometers, 2D or 3D RF quadrupole ion traps or electrostatic ion traps according to the Kingdon principle, for example. At present, however, the time-of-flight mass analyzer seems to be the most favorable, in terms of value for money, for achieving high mass accuracy, high dynamic measurement range, high mass range and fast and flexibly adaptable measuring time.

With knowledge of this invention, those skilled in the art will be able to design different types of arrangement of device components within mass spectrometers for the analysis of product ions from reactions between analyte ions and reactant ions without any loss in sensitivity. For instance, round pole rods have always been shown in the figures for reasons of simplicity. It is understood, however, that the invention can also be carried out with pole electrodes of other designs, while achieving the same advantageous effects.

Although the present invention has been illustrated and described with respect to several preferred embodiments thereof, various changes, omissions and additions to the form and detail thereof, may be made therein, without departing from the spirit and scope of the invention.

What is claimed is:

1. An ion guide system, comprising:

an ion guide having pole rods defining an axis along their length; and a device for a lateral introduction of ions into, or extraction from, the ion guide, wherein a direction of lateral ion introduction or extraction is substantially perpendicular to the axis of the ion guide, the pole rods and the device being configured and positioned such that RF fields with at least a two-fold rotational symmetry around the axis of the ion guide are generated;

wherein, at a point of the lateral introduction or extraction, the pole rods have insulated segments, at least some of which are supplied with a DC voltage in addition to an RF voltage to generate a DC deflection field, which is asymmetric around the axis of the ion guide, for ions laterally introduced or extracted.

2. The ion guide system according to claim 1, wherein the device is formed by modifications of the pole rods of the ion guide and additional electrodes.

3. The ion guide system according to claim 1, wherein the pole rods and the device have mirror symmetry with respect to a plane which contains the axis of the ion guide and is substantially perpendicular to a lateral direction of introduction or extraction of ions through the device.

4. The ion guide system according to claim 3, wherein the RF fields have inverse mirror symmetry to the plane.

5. A mass spectrometer for the acquisition of mass spectra of reaction products from reactions of ions of a first ion species with ions of a second ion species, comprising:

an ion source for producing ions of the first ion species;

an ion guide system, comprising an ion guide having pole rods which define an axis along their length, and a device for a lateral introduction of ions into, or extraction from, the ion guide, wherein a direction of lateral ion introduction or extraction is substantially perpendicular to the axis of the ion guide, the pole rods and the device being configured and positioned such that RF fields with at least a two-fold rotational symmetry around the axis of the ion guide are generated, wherein, at a point of the lateral introduction or extraction, the pole rods have insulated segments, at least some of which are supplied with a DC voltage in addition to an RF voltage to generate DC deflection field, which is asymmetric around the axis of the ion guide, for ions laterally introduced or extracted, the ion guide system further comprising a straight passage along the axis of the ion guide for the ions of the first ion species and at least one lateral entrance for the ions of the second ion species;

an ion source to produce the ions of the second ion species, which are fed to a lateral entrance of the ion guide; and a mass analyzer for acquiring the mass spectra of the reaction products.

6. The mass spectrometer according to claim 5, further comprising a reaction cell into which ions of the first ion species and ions of the second ion species are fed.

7. The mass spectrometer according to claim 5, wherein ions of the first ion species and ions of the second ion species are made to react with each other at a point where the lateral entrance for the ions of the second ion species is located.

8. The mass spectrometer according to claim 5, wherein the supply of ions of the second ion species can be switched on and off.

9. The mass spectrometer according to claim 5, wherein the ion source for the production of ions of the first ion species is an electrospray ion source.

10. The mass spectrometer according to claim 5, wherein the ion source for producing ions of the second ion species is an electron attachment ion source.

11. The mass spectrometer according to claim 5, additionally comprising a cell for collisional fragmentation of ions of the first ion species.

12. The ion guide system according to claim 1, wherein the pole rods have a circular cross section.

13. The ion guide system according to claim 1, wherein the asymmetric DC deflection field is applied when ions are laterally introduced or extracted.

14. The ion guide system according to claim 1, further comprising a first device for lateral ion introduction or extraction and a second device for lateral ion introduction or extraction, the first and second devices being located diametrically opposite each other.

* * * * *

UNITED STATES PATENT AND TRADEMARK OFFICE

CERTIFICATE OF CORRECTION

PATENT NO. : 9,245,724 B2
APPLICATION NO. : 13/560634
DATED : January 26, 2016
INVENTOR(S) : Carsten Stoermer It is certified that error appears in the above-identified patent and that said Letters Patent is hereby corrected as shown below:

Specification

Column 2
Line 23, please delete “modem” and insert --modern--

Signed and Sealed this
Fifth Day of April, 2016

Michelle K. Lee

Michelle K. Lee
*Director of the United States Patent and Trademark Office*